US007201372B2

(12) United States Patent
Kapturowski et al.

(10) Patent No.: US 7,201,372 B2
(45) Date of Patent: Apr. 10, 2007

(54) SHEET ACCUMULATOR SYSTEMS AND METHODS

(75) Inventors: Edward J. Kapturowski, Apex, NC (US); Ronald J. Mich, Zebulon, NC (US)

(73) Assignee: Bowe Bell + Howell Company, Durham, NC (US)

( * ) Notice: Subject to any disclaimer, the term of this patent is extended or adjusted under 35 U.S.C. 154(b) by 0 days.

(21) Appl. No.: 10/366,178

(22) Filed: Feb. 13, 2003

(65) Prior Publication Data

US 2003/0164589 A1 Sep. 4, 2003

Related U.S. Application Data

(60) Provisional application No. 60/356,950, filed on Feb. 14, 2002.

(51) Int. Cl.
*B65H 39/10* (2006.01)

(52) U.S. Cl. ..... 271/298; 271/189; 271/176

(58) Field of Classification Search ..... 271/189, 271/176, 258.02, 288, 258, 207, 298
See application file for complete search history.

(56) References Cited

U.S. PATENT DOCUMENTS

| | | | | |
|---|---|---|---|---|
| 4,026,537 | A | 5/1977 | Harris | |
| 4,295,733 | A * | 10/1981 | Janssen et al. | 399/403 |
| 4,364,702 | A | 12/1982 | Coussot | |
| 4,784,558 | A | 11/1988 | Toriyama | |
| 5,083,769 | A * | 1/1992 | Young, Jr. | 271/280 |
| 5,147,092 | A * | 9/1992 | Driscoll et al. | 271/184 |
| 5,180,157 | A * | 1/1993 | Helit et al. | 271/256 |
| 5,244,200 | A * | 9/1993 | Manzke | 271/198 |
| 5,445,368 | A * | 8/1995 | Lester et al. | 270/59 |
| 5,590,873 | A * | 1/1997 | Smart et al. | 271/303 |
| 5,647,587 | A | 7/1997 | Smart et al. | |
| 5,692,745 | A | 12/1997 | Neifert et al. | |
| 5,794,931 | A * | 8/1998 | Heilman et al. | 271/303 |
| 5,915,686 | A | 6/1999 | Neifert et al. | |
| 6,095,517 | A * | 8/2000 | Dinatale | 271/212 |
| 6,203,006 | B1 * | 3/2001 | Semanick et al. | 271/213 |
| 6,378,860 | B1 * | 4/2002 | Gutierrez et al. | 271/217 |
| 6,568,675 | B1 * | 5/2003 | Boss | 271/292 |
| 6,644,657 | B2 * | 11/2003 | Wright et al. | 271/242 |
| 2004/0056406 | A1 * | 3/2004 | Gunther | 270/52.09 |

FOREIGN PATENT DOCUMENTS

EP 1 061 021 A 12/2000

* cited by examiner

*Primary Examiner*—Patrick Mackey
*Assistant Examiner*—Matthew J. Kohner
(74) *Attorney, Agent, or Firm*—Jenkins, Wilson, Taylor & Hunt, P.A.

(57) ABSTRACT

Sheet accumulator systems and methods are provided for forming a stack of under-accumulated sheets. The method can include advancing sheets in a predetermined sequence and under-accumulating a first portion of the advanced sheets in a first stack. The method can also include under-accumulating a second portion of the advanced sheets in a second stack and automatically stacking the first stack of sheets on the second stack of sheets to form a combined stack wherein the combined stack is in a predetermined sequence.

37 Claims, 2 Drawing Sheets

SHEET ACCUMULATOR SYSTEMS AND METHODS

RELATED APPLICATIONS

This application claims the benefit of U.S. Provisional Patent Application Ser. No. 60/356,950, filed Feb. 14, 2002, the disclosure of which is incorporated herein by reference in its entirety.

TECHNICAL FIELD

The disclosed subject matter relates to sheet accumulator systems and methods. More particularly, the disclosed subject matter relates to sheet accumulator systems and methods for under-accumulating sheets in a mail insertion machine or other device for manipulating stacks of sheets.

BACKGROUND ART

Various sheet accumulator systems have been employed for accumulating sheet material such as paper sheets, documents, and the like into stacks. Accumulators can function to stack sheets in a proper sequence. For example, sheets can be stacked in an "A to Z" sequence, wherein the top sheet in the stack is the first sheet in the sequence and the sheets following are in sequence to the bottom sheet, the last sheet in the sequence. Alternatively, sheets can be stacked by an accumulator in a "Z to A" sequence, wherein the top sheet in the stack is the last sheet in the sequence and the sheets following are in reverse sequence to the bottom sheet, the first sheet in the sequence. Mail insertion machines employ sheet accumulators to accumulate sheets in a stack prior to processing, such as binding, and placement into envelopes.

Mail insertion machines typically transport sheets one-by-one along a "stream" to an accumulator for stacking in an "A to Z" or "Z to A" sequence. Sheets are commonly transported to an accumulator along a stream in a "Z to A" sequence, wherein the first sheet transported is the last sheet in an ordered sequence comprising a document, and the second sheet is the second to last sheet in the ordered sequence. Subsequent sheets are transported in the reverse sequence until the last sheet, the first sheet in the ordered sequence, is transported.

Under-accumulators are known devices for receiving sheets transported in a stream and accumulating the sheets in a sequence one below the other ("under-accumulating"). The accumulation of sheets one below the other is known as under-accumulating. For example, an under-accumulator receiving sheets in a "Z to A" sequence stacks the sheets in a "Z to A" sequence. Conversely, for example, an under-accumulator receiving sheets in an "A to Z" sequence stacks the sheets in an "A to Z" sequence.

Examples of under-accumulators are disclosed in U.S. Pat. Nos. 6,203,006; 5,915,686; 5,794,931; 5,692,745; 5,647,587; 5,590,873; 5,244,200; and 5,147,092. A typical under-accumulator includes at least two driven belts which engage a sheet at its upper and lower surface, respectively. An under-accumulator can also include shaft-mounted pulleys for directing and driving the belts, two side guides which engage and guide the edges of sheets being transported by the belts, a mechanism for lifting a stack of accumulated sheets, a ramp for directing the sheet downward under the stack of sheets, and a sheet-restraining means for preventing the stacked documents from being fed by the belts until all sheets for a particular set have been under-accumulated.

Current under-accumulators are limited in the number of sheets that can be under-accumulated due to the increasing weight of the sheets as they are stacked. This limitation results because it becomes increasingly difficult to overcome the weight of accumulated sheets as the number of sheets stacked increases. The lifting mechanism of an under-accumulator has a limited ability to place another sheet underneath the stack due to the increasing weight of the stack. Typically, the number of sheets required to equal the weight limit of the under-accumulator is known. In this instance, the under-accumulator can include instructions to stop when the predetermined number of sheets has been accumulated.

A common method for under-accumulating a sheet set that exceeds the weight limitation of a single under-accumulator is to separately under-accumulate subsets of the sheet set with the under-accumulator and then manually stack the under-accumulated subsets together in the proper stack sequence. The under-accumulation of sheets in this manner is undesirable because it is time-consuming and laborious for an operator. Therefore, it is desired to provide a system and methods for automatically under-accumulating a set of sheets in a stack, wherein the weight of the stack can exceed the weight limit for an under-accumulator.

SUMMARY

According to one aspect, a method is provided for forming a stack of under-accumulated sheets. The method can include advancing sheets in a predetermined sequence and under-accumulating a first portion of the advanced sheets in a first stack. The method can also includes under-accumulating a second portion of the advanced sheets in a second stack and automatically stacking the first stack of sheets on the second stack of sheets to form a combined stack wherein the combined stack is in a predetermined sequence.

According to a second aspect, a method is provided for forming a stack of under-accumulated sheets. The method can include advancing sheets of a sheet set in a predetermined sequence. The method can also include determining whether a first under-accumulation deck can under-accumulate the sheet set. Further, the method can include under-accumulating a first portion of the advanced sheets in a first stack in the first under-accumulation deck if the first under-accumulation deck cannot under-accumulate the sheet set. The method can also include under-accumulating a second portion of the advanced sheets in a second stack in a second under-accumulation deck if the first under-accumulation deck cannot under-accumulate the sheet set. Additionally, the method can include automatically stacking the first stack of sheets on the second stack of sheets to form a combined stack wherein the combined stack is in a predetermined sequence, if the first under-accumulation deck cannot under-accumulate the sheet set.

According to a third aspect, a system is provided for forming a stack of under-accumulated sheets. The system can include an advancing mechanism for advancing sheets in a predetermined sequence and a first under-accumulation deck for under-accumulating a first portion of the advanced sheets in a first stack. The system can also include a second under-accumulation deck for under-accumulating a second portion of the advanced sheets in a second stack. Further, the system can include a stacking device operable to stack the first stack of sheets on the second stack of sheets to form a combined stack wherein the combined stack is in a predetermined sequence.

According to a fourth aspect, a system is provided for forming a stack of under-accumulated sheets. The system can include an advancing mechanism for advancing sheets in a predetermined sequence and a first under-accumulation deck for under-accumulating a first portion of the advanced sheets in a first stack. The system can also include a second under-accumulation deck for under-accumulating a second portion of the advanced sheets in a second stack and a controller operable to determine whether the first under-accumulation deck can under-accumulate the advanced sheets. The system can further include a stacking device operable to stack the first stack of sheets on the second stack of sheets to form a combined stack wherein the combined stack is in a predetermined sequence.

According to a fifth aspect, a computer-readable medium is provided having stored thereon instructions for forming a stack of under-accumulated sheets. Execution of the code instructions by a computer causes the computer to control an accumulator system so as to perform a sequence of steps. The steps can include advancing sheets in a predetermined sequence and under-accumulating a first portion of the advanced sheets in a first stack. The computer-controlled steps can also include under-accumulating a second portion of the advanced sheets in a second stack and stacking the first stack of sheets on the second stack of sheets to form a combined stack wherein the combined stack is in a predetermined sequence.

According to a sixth aspect, a computer-readable medium is provided having stored thereon instructions for forming a stack of under-accumulated sheets. Execution of the code instructions by a computer causes the computer to control an accumulator system so as to perform a sequence of steps. The steps can include advancing sheets of a sheet set in a predetermined sequence and determining whether a first under-accumulation deck can under-accumulate the sheet set. The computer-controlled steps can also include under-accumulating a first portion of the advanced sheets in a first stack in the first under-accumulation deck if the first under-accumulation deck cannot under-accumulate the sheet set. The computer-controlled steps can further include under-accumulating a second portion of the advanced sheets in a second stack in a second under-accumulation deck if the first under-accumulation deck cannot under-accumulate the sheet set. The computer-controlled steps can also include stacking the first stack of sheets on the second stack of sheets to form a combined stack wherein the combined stack is in a predetermined sequence if the first under-accumulation deck cannot under-accumulate the sheet set.

A computer-readable or machine-readable "medium," as used herein, can be any physical element or carrier wave, which can include instructions or code for a sequence of steps in a machine-readable form or can include associated data in a machine-readable form. Examples of physical forms of such media include floppy disks, flexible disks, hard disks, magnetic tape, any other magnetic medium, a CD-ROM, a DVD-ROM, any other optical medium, a RAM, a ROM, a PROM, an EPROM, a FLASH-EPROM, any other memory chip or cartridge, as well as media bearing the software in a scannable format. A carrier wave type of medium is any type of signal that may carry digital information representative of the data or the instructions or code for the sequence of steps. Such a carrier wave may be received via a wireline or fiber-optic network or other similar communication type media, for example, via a modem, or as a radio-frequency or infrared signal, or any other type of signal which a computer or the like may receive and decode via a telecommunications medium.

It is therefore an object to provide novel sheet accumulator systems, methods and software, for use in under-accumulating sheets for a mail insertion machine or other device for manipulating stacks of sheets.

An object having been stated hereinabove, and which is achieved in whole or in part by the system and method disclosed herein, other objects will become evident as the description proceeds when taken in connection with the accompanying drawings as best described hereinbelow.

BRIEF DESCRIPTION OF THE DRAWINGS

Exemplary embodiments of the disclosed subject matter will now be explained with reference to the accompanying drawings, of which.

DETAILED DESCRIPTION

The disclosed subject matter now is described more fully hereinafter with reference to the accompanying drawings, in which preferred embodiments of the disclosed subject matter are shown. The disclosed subject matter can, however, be embodied in many different forms and should not be construed as limited to the embodiments set forth herein; rather, these embodiments are provided so that this disclosure will be thorough and complete, and will fully convey the scope of the disclosed subject matter to those skilled in the art.

As will be appreciated by one of skill in the art, the disclosed subject matter can be embodied as a method, system, or computer program product. Accordingly, the disclosed subject matter can take the form of an entirely hardware embodiment, an entirely software embodiment, or an embodiment combining software and hardware aspects. Furthermore, the disclosed subject matter can take the form of a computer program product on a computer-readable storage medium having computer-readable program code and/or control data carried by the medium. Any suitable computer readable medium can be utilized as described above including, for example, hard disks, CD-ROMs, optical storage devices, or magnetic storage devices as well as communication signals and physical communication media.

As can readily be appreciated by those of skill in the art, the systems and methods of the disclosed subject matter can be applied to several types of machines requiring sheet under-accumulation. As described herein, the disclosed subject matter can be applied to mail insertion machines and can be used with other device suitable devices for manipulating stacks of sheets. For example, the disclosed subject matter can be applied to copiers, printers, and facsimile machines or any other suitable devices or systems requiring sheet under-accumulation.

Figure 1:
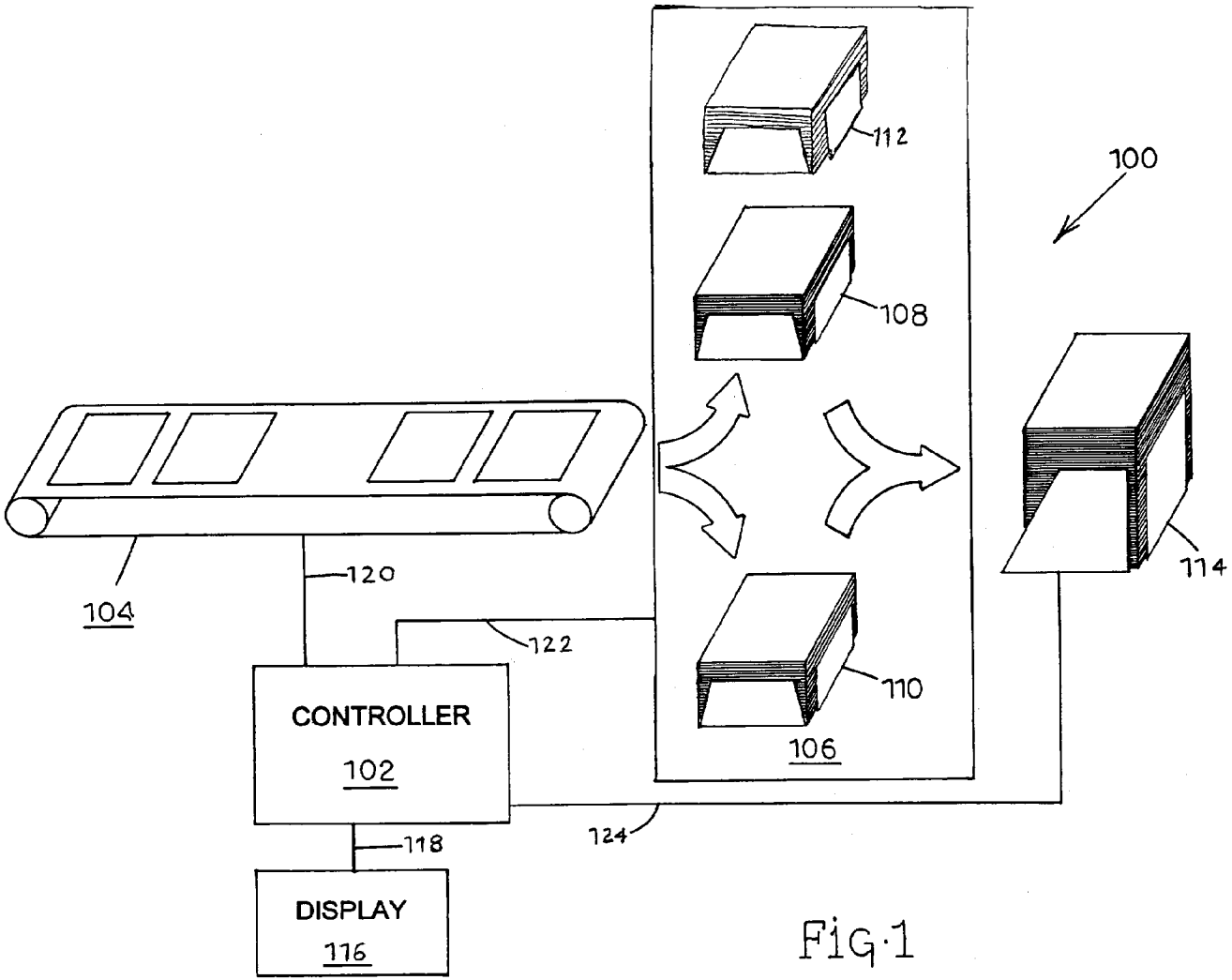
FIG. 1 is a schematic diagram of a mail insertion system for forming a stack of under-accumulated sheets according to an embodiment of the disclosed subject matter.

Referring to FIG. 1, a schematic diagram of an under-accumulation system, generally designated 100, according to an embodiment of the subject matter described herein is illustrated. Under-accumulation system 100 can include a controller 102 having hardware and software components for controlling the operation of an advancing mechanism 104 and a multi-deck accumulator 106 having a first under-accumulation deck 108, a second under-accumulation deck 110, and a third under-accumulation deck 112. Controller 102 can also control the operation of a stacking device 114.

Under-accumulation system 100 can be associated with additional components (not shown) as part of a mail insertion system or the like.

Advancing mechanism 104 can include components for receiving the sheets of a sheet set one-by-one or in a stack and advancing the sheets downstream one-by-one. In one embodiment, advancing mechanism 104 can include a track having more than one roller for advancing sheets downstream to multi-deck accumulator 106. During operation, advancing mechanism 104 can receive sheets of a set one-by-one from an upstream device such as a printer. The sheets can be delivered to multi-deck accumulator 106 in an "A to Z" sequence for under-accumulation in an "A to Z" sequence, or delivered in a "Z to A" sequence for under-accumulation in a "Z to A" sequence.

Multi-deck accumulator 106 can receive the sheets from advancing mechanism 104 and selectively divert the sheets to deck 108, deck 110 or deck 112 as instructed by controller 102. In one embodiment, decks 108, 110, and 112 are positioned above one another. Alternatively, decks 108, 110, and 112 can be positioned beside one another. Multi-deck accumulator 106 can include conveying paths for advancing sheets to decks 108, 110, and 112. Sheets advanced to multi-deck accumulator 106 can be selectively diverted along one of the conveying paths to one of decks 108, 110, and 112 via a divert gate. The divert gate can include a pivotally movable, divert plate positioned upstream of multi-deck accumulator 106 for diverting the sheets. In one embodiment, the divert gate can be selectively movable to deflect advancing sheets upward to guide the sheets into the conveying path for advancement to deck 108, to deflect advancing sheets downward to guide the sheets into the conveying path for advancement to deck 110, or to deflect advancing sheets further downward to guide the sheets into the conveying path for advancement to deck 112. An exemplary multi-deck accumulator is disclosed in U.S. Pat. No. 5,794,931, the contents of which are incorporated herein by reference.

Decks 108, 110, and 112 can under-accumulate sheets received from advancing mechanism 104 and store the sheet stacks until receiving instructions to advance the stacks to stacking device 114. The sheet stacks in decks 108, 110, and 112 can be merged and stacked on top of one another at stacking device 114. Sheet stacks can be delivered to stacking device 114 via a mechanism such as one or more divert gates and rollers. Stacking device 114 can store the under-accumulated sheets until needed for further downstream processing such as binding or insertion into a package or envelope.

In one embodiment, controller 102 controls the under-accumulation of a set of sheets when the weight of the set exceeds the capacity of deck 108 or deck 110. In this instance, the set can be divided into a first and second set for separate under-accumulation by decks 108 and 110, respectively. For example, controller 102 can instruct a divert gate to divert a first set of sheets received from advancing mechanism 104 to deck 108 for under-accumulation. Next, controller 102 can instruct the divert gate to divert a second set of sheets to deck 110 for under-accumulation. Controller 102 can then instruct deck 110 to deliver its under-accumulated second sheet stack to stacking device 114 and then instruct deck 108 to stack its under-accumulated first sheet stack on top of the stack from deck 110. Thus, this results in a single stack of under-accumulated sheets for the combined first and second set of sheets. An exemplary stacking device is disclosed in U.S. Pat. No. 5,899,453, the contents of which are incorporated herein by reference.

In one embodiment, controller 102 can be a programmable device, such as a computer. Controller 102 can be connected to a touch screen display 116 via communication line 118 for receiving information from and communicating information to an operator. Alternatively, under-accumulation system 100 can include a monitor, mouse, keyboard, or other suitable input and/or output device known to those skilled in the art. Controller 102 can communicate instructions and monitor components 104, 106, 108, 110, 112, and 114 via communication lines 120, 122, and 124. Instructions for forming a stack of under-accumulated sheets can be stored in the components of controller 102, either within internal memory or on internal disk storage. The instructions can also be stored on local or remote computer-readable media.

The disclosed subject matter is described below with reference to a flow chart illustration of computer program products according to the subject matter disclosed herein. It will be understood that each block of the flow chart illustrations, and combinations of blocks in the flow chart illustrations, can be implemented by computer program instructions. These computer program instructions can be loaded onto a general purpose computer, special purpose computer, or other programmable data processing apparatus to produce a machine, such that the instructions which execute on the computer or other programmable data processing apparatus create means for implementing the functions specified in the flow chart block or blocks. These computer program instructions can also be stored in a computer-readable memory that can direct a computer or other programmable data processing apparatus to function in a particular manner, such that the instructions stored in the computer-readable memory produce an article of manufacture including instruction means which implement the function specified in the flow chart block or blocks. The computer program instructions can also be loaded onto a computer or other programmable data processing apparatus to cause a series of operational steps to be performed on the computer or other programmable apparatus to produce a computer implemented method such that the instructions which execute on the computer or other programmable apparatus providing steps for implementing the functions specified in the flow chart block or blocks.

Accordingly, blocks of the flow chart illustrations support combinations of means for performing the specified functions, combinations of steps for performing the specified functions and program instruction means for performing the specified functions. It will also be understood that each block of the flow chart illustrations, and combinations of blocks in the flow chart illustrations, can be implemented by special purpose hardware-based computer systems which perform the specified functions or steps, or combinations of special purpose hardware and computer instructions.

Figure 2:
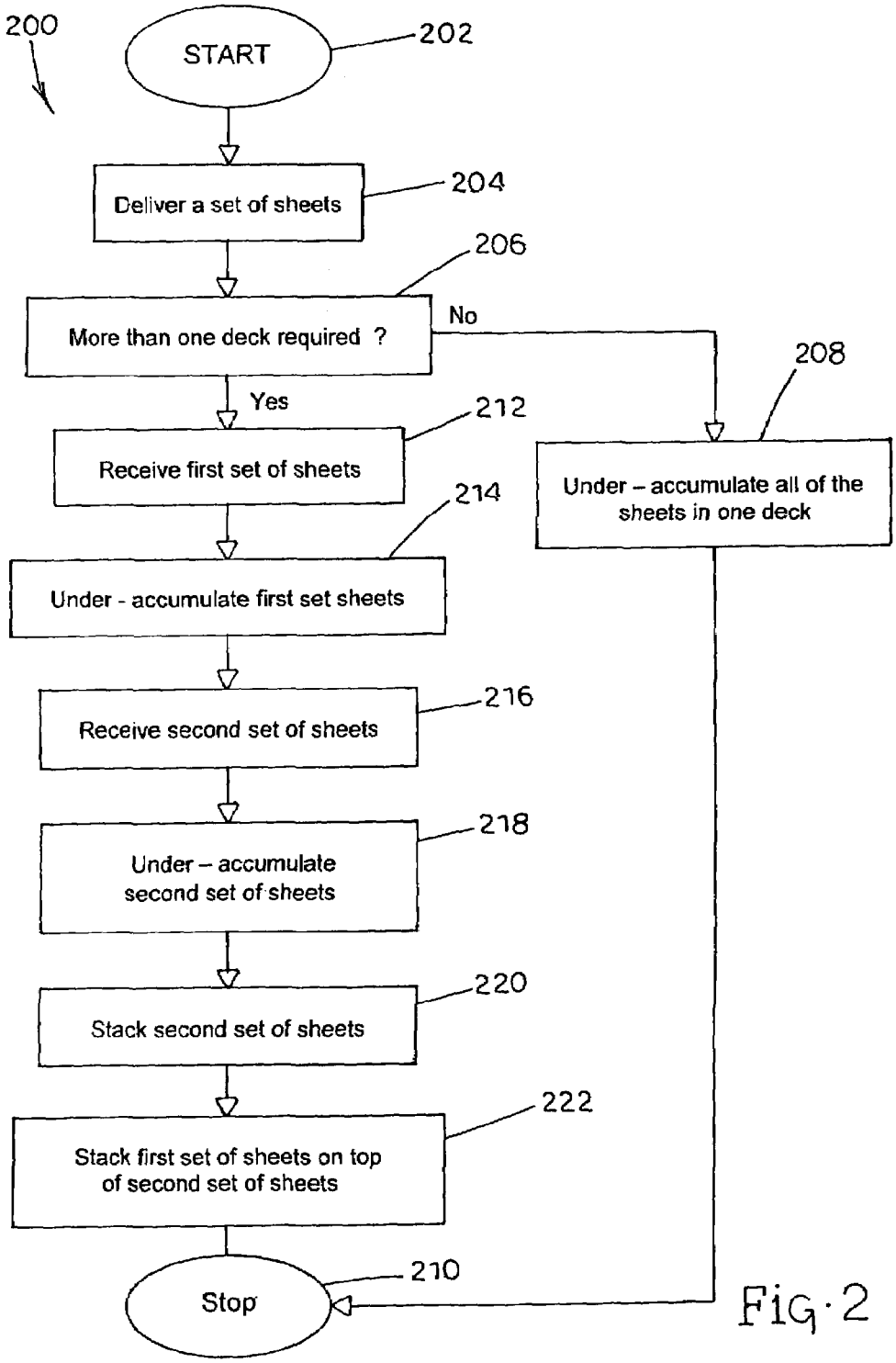
FIG. 2 is a flow chart illustrating a method for under-accumulating sheets in a mail insertion machine according to one embodiment of the disclosed subject matter.

Referring now to FIG. 2, a flow chart, generally designated 200, is provided which illustrates a preferred embodiment of a method for under-accumulation sheets in a stack in a mail insertion machine according to one embodiment of the disclosed subject matter. This method can be controlled by controller 102. Alternatively, this method can be performed by a computer system, which can be local or remote. The method begins at the step indicated by reference numeral 202. In step 204, advancing mechanism 104 delivers a set of sheets to multi-deck accumulator 106 in a "Z to A" sequence for under-accumulation in a "Z to A" sequence. Alternatively, the sheets of a set can be delivered in an "A to Z" sequence for under-accumulation in an "A to Z" sequence.

Controller 102 can determine whether more than one deck is required for under-accumulating the sheet set (step 206). More than one deck is required when the set of sheets exceeds the maximum amount that can be under-accumulated by either deck 108 or deck 110. In this embodiment, controller 102 determines whether more than one deck is required based on program job information regarding the number of sheets in the set and/or information regarding the weight of a single sheet of the set of sheets. Alternatively, sheets of a set can be under-accumulated in one deck and then diverted to another deck for under-accumulation when the first deck reaches its limit. Controller 102 can receive detection information regarding the number of sheets or weight of subset, as the subset is accumulated within a deck for determining whether the deck has reached its capacity. Based on the number of sheets in the set, controller 102 can determine whether the sheet number exceeds the number of sheets that can be under-accumulated by deck 108 or deck 110. If the number of sheets in the set exceeds the maximum number that can be under-accumulated by deck 108 or deck 110, controller 102 controls the delivery of a first set of sheets received by accumulator 106 to deck 108 and a second set of sheets, following the first set of sheets, to deck 110, as described in further detail below. Otherwise, all of the sheets in the set can be under-accumulated by deck 108. Controller 102 can receive information regarding the maximum number of sheets that can be under-accumulated by deck 108 and information regarding the total number of sheets in the set from program job information associated with the sheet set.

Alternatively, controller 102 can determine whether to use decks 108 and 110 based on the weight of the sheets in the set and the weight capacity of deck 108 for under-accumulating sheets. Controller 102 can receive information regarding the weight of the sheets in the set and the maximum weight capacity of deck 108 from a program job associated with the sheet set. If the weight of the sheets in the set exceeds the maximum weight capacity of deck 108, a first received set of sheets having a weight up to the maximum weight capacity of deck 108 can be diverted to deck 108 for under-accumulation. Next, the following sheets can be diverted to deck 110 for under-accumulation.

Deck 112 can be used when the weight and/or number of sheets of a set of sheets exceeds the weight or number that can be under-accumulated by the combination of decks 108 and 110. The sheets remaining after under-accumulation by decks 108 and 110 can be diverted to deck 112 for under-accumulation and subsequently delivered in reverse order to stacking device 112 for proper stacking.

If controller 102 determines that more than one deck is not required at step 206, all of the sheets of the set are diverted to a single deck, deck 108, for under-accumulation (step 208). Next, the under-accumulated sheets in deck 108 can be delivered to accumulator 106 to await delivery downstream. The method for under-accumulating the sheet set stops at step 210.

If controller 102 determines more than one deck is required at step 206, multi-deck accumulator 106 receives a first set of sheets from advancing mechanism 104 (step 212). The first set of sheets is less than or equal to the maximum amount that can be under-accumulated by deck 108. In step 214, the first set of sheets is delivered to deck 108, under-accumulated, and stacked. Thus, the first sheet received from advancing mechanism 104 in the first set of sheets is the top sheet on the stack in deck 108, and the last sheet received in the first set of sheets is the bottom sheet. The first set of sheets is comprised of sheets received from advancing mechanism 104 beginning with the first sheet.

In step 216, accumulator 106 receives a second set of sheets from advancing mechanism 104 beginning with the next sheet in sequence following the last sheet in the sequence from the first set of sheets. The second set of sheets is diverted to deck 110, under-accumulated, and stacked (step 218). Thus, the next sheet in sequence following the last sheet from the first set of sheets is the top sheet on the stack in deck 110, and the last sheet in the sequence is the bottom sheet. The second set of sheets is comprised of sheets received from advancing mechanism 104 beginning with the next sheet in sequence following the last sheet from the first set of sheets, and the last sheet is the last sheet in the sequence of sheets.

Additional decks in the multi-deck accumulator 106 can be used if the number of sheets in the sequence is greater than the number of sheets that can be under-accumulated in decks 108 and 110. Each deck used under-accumulates the maximum number of sheets possible and stores the sheets until all the sheets have been under-accumulated into decks. An error message can be displayed to the operator on display 116 if the number of sheets in the sequence is greater than the number of sheets that can be under-accumulated in decks 108 and 110.

In step 220, the last set of sheets under-accumulated in deck 110 is delivered to stacking device 114 and stacked. This is the second set of sheets in this embodiment wherein two decks are employed.

Next, the subsequent sets of sheets are transported to stacking device 114 and stacked in the reverse sequence that they were under-accumulated (step 222). Therefore, in this embodiment the first set of sheets in deck 108 is transported to stacking device 114 and stacked on top of the second set of sheets.

Next, the method can stop at step 210. Thus, the sheets are stacked in a "Z to A" sequence as received from advancing mechanism 104. The sheets can then be further processed by under-accumulation system 100.

Controller 102 can be implemented in a general-purpose computer system. Whether using a server, a personal computer or other type of computer, such a system typically includes a bus or other communication mechanism for communicating information, and a processor coupled with the bus for processing information in accord with program instructions. The computer system also typically includes a main memory, such as a random access memory (RAM) or other dynamic storage device, coupled to the bus, for storing information and instructions to be executed by the processor. The main memory also can be used for storing temporary variables or other intermediate information, during execution of instructions by the processor. The computer system can also include a read only memory (ROM) or other static storage device coupled to the bus, for storing static information and instructions for the processor. A storage device, such as a magnetic disk (hard drive and/or floppy) or optical disk, is provided and coupled to the bus, for mass storage of information and instructions.

The computer system can also provide the local user interface to system 100, for example, if the computer is implemented as a personal or workstation. The processor of the computer system can be coupled via the bus to interfaces/drivers for a display, such as a cathode ray tube (CRT) or a liquid crystal display (LCD) or other flat-panel display, for displaying information to a computer user. An input device, typically including alphanumeric and other keys, is coupled to the bus for communicating information and command selections to the processor. Another type of common user input device is a cursor control and selection device, such as a mouse, a trackball, or cursor direction keys for communicating direction information and command selections to the processor and for controlling cursor movement on display and inputting user selections of displayed information.

The computer system can also include input/output interfaces for external links. One or more such interfaces provides data exchange with elements of multi-deck accumulator 106 and stacking device 114 during operations and to send control instructions to elements to multi-deck accumulator 106 and stacking device 114. The computer system can also include a modem or local area network (LAN) interface, to enable the system to communicate with remote data devices for reporting and/or remote control purposes or for downloading of program instructions and/or control data into the computer system.

The disclosed subject matter can be implemented in a variety of communications environments including a Local Area Network (LAN) and Wide Area Network (WAN) environments. Implementation can be in communications environments utilizing TCP/IP communications protocol, such as the Internet, and environments utilizing SNA protocol. Hardware for the implementation is generally consistent with typical personal computing equipment, and does not generally require special environmental conditions other than a typical office environment. In one exemplary embodiment, the disclosed subject matter can be implemented on an International Business Machines™ or IBM™-compatible personal computer and software capable of supporting a thin wire Ethernet TCP/IP environment. Controller 102 can be based on an Intel™ processor and having sufficient memory to perform all functions efficiently. The disclosed subject matter can be implemented via other computing device, including, but not limited to, mainframe computing systems and mini-computers.

The disclosed subject matter can be written in various computer languages including, but not limited to, C++, Smalltalk, Java, and other conventional programming languages such as BASIC, FORTRAN, and COBOL.

Computer readable program code is provided for receiving processing system operation related information from each of a plurality of under-accumulation devices, and for representing each of the under-accumulation devices as an interactive icon on a display connected to a data processing system. Each interactive icon has indicia associated therewith which displays the operation related information for a respective under-accumulation device and changes appearance in response to a change in the operation related information. Computer readable program code means is provided for displaying selective operation related information about a respective under-accumulation device in response to user actions, and for displaying operation related information for each under-accumulation device in real time. Computer readable program code means is also provided for adding, deleting, and modifying the location and appearance of the interactive icons.

Hence, at different times all or portions of the executable code or related control data for the software can reside in physical media or be carried by electromagnetic media. Physical hardware media can include the memories and mass storage of the computer processing system serving as controller 102, such as various semiconductor memories, tape drives, disc drives and the like of general-purpose computer systems. All or portions of the software can at times be communicated through the Internet or various other telecommunication networks. Such communications, for example, can serve to load the software from another computer (not shown), for example, into the computer processing system serving as controller 102. Thus, another type of media that can be the software elements includes optical, electrical and electromagnetic waves such as used across physical interfaces between local devices, through wired and optical landline networks and over various air-links. The physical elements carrying such signals also can be considered as media, in that they can convey the software elements to the computer system for reading and execution thereof.

It will be understood that various details of the subject matter disclosed herein can be changed without departing from the scope of the disclosed subject matter. Furthermore, the foregoing description is for the purpose of illustration only, and not for the purpose of limitation as the disclosed subject matter is defined by the claims.

What is claimed is:

1. A method for forming a stack of under-accumulated sheets in an under-accumulation process for mail processing, comprising:

(a) advancing an unassembled set of sheets to be assembled in a single stack in a predetermined sequence;

(b) receiving program job information for the unassembled set of sheets during advancement of the unassembled set of sheets and prior to advancement of the unassembled set of sheets to a first set of sheets to a first under-accumulator;

(c) determining whether the unassembled set of sheets can be under-accumulated in a first under-accumulator based upon the program job information and information regarding a capacity of the first under-accumulator;

(d) under-accumulating a portion of the advanced sheets in a first stack in the first under-accumulator to a level determined based upon the program job information;

(e) under-accumulating a remaining portion of the advanced sheets in a second stack in a second under-accumulator wherein a last sheet in the predetermined sequence is under-accumulated last in the second stack; and (f) stacking the first stack of sheets on the second stack of sheets to assemble the single stack of sheets wherein the last sheet is on a bottom of the single stack.

2. The method of claim 1 wherein the advanced set of sheets are in a Z to A sequence when advancing to the first under-accumulator.

3. The method of claim 2 wherein the first and second stacks are in a Z to A sequence.

4. The method of claim 1 wherein the single stack of sheets is in a Z to A sequence from top to bottom.

5. The method of claim 1 wherein the advanced set of sheets is in an A to Z sequence when advancing to the first under-accumulator.

6. The method of claim 5 wherein the first and second stacks are in an A to Z sequence.

7. The method of claim 1 wherein the single stack of sheets is in an A to Z sequence from top to bottom.

8. The method of claim 1 wherein step (c) comprises determining whether the unassembled set of sheets can be under-accumulated in the first under-accumulator based upon the program job information indicating a total number of sheets to be in the set or a weight of sheets to be in the set and based upon a sheet capacity or a weight capacity of the first under-accumulator.

9. The method of claim 1 wherein step (f) comprises advancing the second stack of sheets to a stacking device.

10. The method of claim 1 further comprising under-accumulating additional portions of the advanced set of sheets in at least one separate stack in addition to the first and second stacks of sheets.

11. The method of claim 1 wherein the program job information comprises information regarding a total number of sheets to be in the set.

12. The method of claim 11 wherein the program job information further comprises information regarding a maximum number of sheets that can be under-accumulated by the first under-accumulator.

13. The method of claim 12 wherein step (c) comprises comparing a total number of sheets to be in the set to a maximum number of sheets that can be under-accumulated by the first under-accumulator.

14. The method of claim 1 wherein the program job information further comprises information regarding what a weight of the set will be.

15. The method of claim 14 wherein the program job information further comprises information regarding a weight capacity of the first under-accumulator.

16. The method of claim 15 wherein step (c) further comprises comparing what a weight of the set will be to a weight capacity of the first under-accumulator.

17. A system for forming a stack of under-accumulated sheets in an under-accumulation process for mail processing, comprising:

(a) an advancing mechanism for advancing an unassembled set of sheets to be assembled in a single stack in a predetermined sequence;

(b) a first under-accumulator for under-accumulating a first portion of the advanced set of sheets in a first stack;

(c) a second under-accumulator for under-accumulating a second portion of the advanced set of sheets in a second stack wherein a last sheet in the predetermined sequence is under-accumulated last in the second stack;

(d) a stacking device operable to stack the first stack of sheets on the second stack of sheets to assemble the single stack of sheets wherein the last sheet is on a bottom of the single stack; and (e) a controller for receiving program job information for the unassembled set of sheets during advancement of the unassembled set of sheets prior to advancement of the unassembled set of sheets to a first set of sheets to a first under-accumulator, and wherein the controller is also adapted for controlling under-accumulation of the advanced sheets to under-accumulate the first portion of the advanced sheets in the first stack in the first under-accumulator to a level determined based upon the program job information and to under-accumulate the second portion of the advanced sheets in the second stack in the second under-accumulator.

18. The system of claim 17 wherein the advancing mechanism is adapted for advancing the sheets in a Z to A sequence prior to under-accumulation.

19. The system of claim 18 wherein the first and second stacks are in a Z to A sequence.

20. The system of claim 17 wherein the single stack of sheets is in a Z to A sequence.

21. The system of claim 17 wherein the advancing mechanism is adapted for advancing sheets in an A to Z sequence prior to under-accumulation.

22. The system of claim 17 wherein the first and second stacks are in an A to Z sequence.

23. The system of claim 17 wherein the single stack of sheets is in an A to Z sequence.

24. The system of claim 17 further comprising additional under-accumulators for under-accumulating additional portions of the advanced set of sheets in at least one separate stack in addition to the first and second stacks of sheets.

25. The system of claim 17 wherein the program job information received by the controller comprises a total number of sheets to be in the set to control under-accumulation of the second portion of the advanced set of sheets.

26. The system of claim 25 wherein the program job information received by the controller further comprises a maximum number of sheets that can be under-accumulated by the first under-accumulator to control under-accumulation of the second portion of the advanced set of sheets.

27. The system of claim 26 wherein the controller is further operable for comparing a total number of sheets to be in the single stack to a maximum number of sheets that can be under-accumulated by the first under-accumulator to control under-accumulation of the second portion of the advanced set of sheets.

28. The system of claim 17 wherein the program job information received by the controller comprises what a weight of the single stack will be to control under-accumulation of the second portion of the advanced set of sheets.

29. The system of claim 28 wherein the program job information received by the controller further comprises a weight capacity of the first under-accumulator to control under-accumulation of the second portion of the advanced set of sheets.

30. The system of claim 29 wherein the controller is operable to compare what the weight of the single stack will be to the weight capacity of the first under-accumulator to control under-accumulation of the second portion of the advanced set of sheets.

31. The system of claim 17 further comprising an input/output device for receiving information from and communicating information to an operator.

32. A system for forming a stack of under-accumulated sheets in an under-accumulation process for mail processing, comprising:

(a) an advancing mechanism for advancing an unassembled set of sheets to be assembled in a single stack in a predetermined sequence;

(b) a first under-accumulator for under-accumulating a first portion of the advanced set of sheets in a first stack;

(c) a second under-accumulator for under-accumulating a second portion of the advanced set of sheets in a second stack after the first portion has been under-accumulated;

(d) a controller for receiving program job information for the unassembled set of sheets during advancement of the unassembled set of sheets and prior to advancement of the unassembled set of sheets to a first set of sheets to a first under-accumulator, and wherein the controller is also adapted for controlling under-accumulation of the advanced sheets to under-accumulate the first portion of the advanced sheets in the first stack in the first under-accumulator to a level determined based upon the program job information and to under-accumulate the second portion of the advanced sheets in the second stack in the second under-accumulator, wherein the controlling is in response to a determination, prior to under-accumulation in the first under-accumulator, that the first under-accumulator is not of a capacity to under-accumulate all of the sheets to be in the set, and wherein the determination is based upon the program job information indicating a weight capacity of the first under-accumulator and a weight of the sheets to be in the set; and (e) a stacking device operable to stack the first stack of sheets from the first under-accumulator on the second stack of sheets from the second under-accumulator to assemble the single stack of sheets wherein the last sheet in the predetermined sequence is under-accumulated last in the second stack.

33. A program product, comprising at least one computer-readable medium having stored thereon instructions, wherein execution of the instructions by at least one programmable computer for controlling an accumulator system causes the accumulator system to perform a sequence of steps for forming a stack of under-accumulated sheets, the sequence of steps comprising:

(a) advancing an unassembled set of sheets to be assembled in a single stack in a predetermined sequence;

(b) receiving program job information for the unassembled set of sheets during advancement of the unassembled set of sheets and prior to advancement of the unassembled set of sheets to a first set of sheets to a first under-accumulator;

(c) determining whether a first under-accumulator is of a capacity to under-accumulate all of the advanced set of sheets based upon the program job information and information regarding a capacity of the first under-accumulator;

(d) under-accumulating a first portion of the advanced set of sheets in a first stack in the first under-accumulator to a level determined based upon the program job information;

(e) under-accumulating a second portion of the advanced set of sheets in a second stack in a second under-accumulator wherein a last sheet in the predetermined sequence is under-accumulated last in the second stack; and (f) stacking the first stack of sheets on the second stack of sheets to assemble the single stack of sheets wherein the last sheet is on a bottom of the single stack.

34. The computer-readable medium of claim 33, wherein step (c) comprises determining whether the first under-accumulator is of a capacity to under-accumulate all of the sheets to be in the single stack based upon the program job information indicating a weight of sheets to be in the single stack or a total number of sheets to be in the single stack.

35. The computer-readable medium of claim 34, wherein step (c) comprises determining whether the first under-accumulator is of a capacity to under-accumulate all of the sheets to be in the single stack based upon the program job information indicating a comparison of the weight capacity of the first under-accumulator with the weight of sheets to be in the single stack.

36. A method for forming a stack of under-accumulated sheets in an under-accumulation process for mail processing, comprising:

(a) advancing an unassembled set of sheets for assembly to be assembled in a single stack in a predetermined sequence;

(b) receiving program job information for the unassembled set of sheets during advancement of the unassembled set of sheets and prior to advancement of the unassembled set of sheets to a first set of sheets to a first under-accumulator;

(c) determining whether the unassembled set of sheets can be under-accumulated in a first under-accumulator based upon the program job information and information regarding a capacity of the first under-accumulator;

(d) under-accumulating a first portion of the advanced set of sheets in a first stack in the first under-accumulator to a level determined based upon the program job information;

(e) maintaining the first portion of sheets in the first stack until receiving instructions to advance the first stack for stacking;

(f) under-accumulating a second portion of the advanced set of sheets in a second stack in a second under-accumulator after under-accumulation of the first stack wherein a last sheet in the predetermined sequence is under-accumulated last in the second stack;

(g) maintaining the second portion of sheets in the second stack until receiving instructions to advance the second stack for stacking; and (h) stacking the first stack on the second stack to assemble a single stack of sheets wherein the last sheet from the predetermined sequence is on a bottom of the single stack.

37. A system for forming a stack of under-accumulated sheets in an under-accumulation process for mail processing, comprising:

(a) an advancing mechanism for advancing an unassembled set of sheets to be assembled in a single stack in a predetermined sequence;

(b) a memory for storing program job information received for the unassembled set of sheets during advancement of the unassembled set of sheets;

(c) a first under-accumulator for under-accumulating a first portion of the advanced set of sheets in a first stack to a level determined based upon the program job information and for maintaining the first portion of sheets in the first stack until receiving instructions to advance the first stack for stacking;

(d) a second under-accumulator for under-accumulating a second portion of the advanced set of sheets in a second stack after the first portion has been under-accumulated and for maintaining the second portion of sheets in the second stack until receiving instructions to advance the second stack for stacking;

(e) a controller for receiving program job information for the unassembled set of sheets during advancement of the unassembled set of sheets prior to advancement of the unassembled set of sheets to a first set of sheets to a first under-accumulator, and wherein the controller is also adapted for sending instructions to the first and second under-accumulators, for determining whether the advanced set of sheets can be under-accumulated in the first under-accumulator based upon the program job information and information regarding a capacity of the first under-accumulator, and for controlling when the first and second under-accumulators advance the first and second stacks, respectively, for stacking; and (f) a stacking device operable to stack the first stack of sheets from the first under-accumulator on the second stack of sheets from the second under-accumulator to assemble the single stack of sheets wherein a lowermost sheet in the single stack is a sheet which was advanced last in the predetermined sequence prior to under-accumulation.

* * * * *